US005087041A

United States Patent [19]

Gagnon

[11] Patent Number: 5,087,041

[45] Date of Patent: Feb. 11, 1992

[54] COVER PANEL FOR PIN SETTER BOWLING MACHINE

[76] Inventor: Joseph L. Gagnon, 296 Swaggertown Rd., Scotia, N.Y. 12302

[21] Appl. No.: 681,574

[22] Filed: Apr. 5, 1991

[51] Int. Cl.[5] ..... A63D 5/00

[52] U.S. Cl. ..... 273/54 R

[58] Field of Search ..... 273/54 R, 37, 42 R

[56] References Cited

U.S. PATENT DOCUMENTS

| | | | |
|---|---|---|---|
| 2,485,347 | 10/1949 | Anderson et al. | 273/54 R |
| 3,018,105 | 1/1962 | Grogoza | 273/54 R |
| 3,738,656 | 6/1973 | Rockwood et al. | 273/54 R |
| 4,339,129 | 7/1982 | Gautraud | 273/54 R |

*Primary Examiner*—William H. Grieb

*Attorney, Agent, or Firm*—Schmeiser, Morelle & Watts

[57] ABSTRACT

A cover panel frame for retrofitting an automatic pin setter machine. The framework moves between and open and closed position and in said open position the panels lie in different planes than adjacent cover panels.

6 Claims, 2 Drawing Sheets

COVER PANEL FOR PIN SETTER BOWLING MACHINE

FIELD OF THE INVENTION

Generally this invention relates to equipment used in the sport of bowling. More specifically, the invention is a cover panel which is located in front of the bowling alley pin setter machine.

BACKGROUND OF THE INVENTION

The origins of bowling cannot be easily traced and some of its prior titles such as lawn bowling and ten pins are just a few examples of the earlier origins of the sport. While some advances were initially made in the sport, one significant difficulty remained. Namely, the need to have a person resetting the pins after each ball was thrown. Not only did this slow the game tremendously but the increased manpower and costs involved virtually stalled the expansion of the sport to the majority of the purchasing public. With the invention of automatic pin setters the sport of bowling entered a new age and the sport experienced tremendous growth and popularity.

The proliferation of automatic pin setters and bowling alleys in general led to the need for other items including cover panels which were positioned in front of the automatic pin setting machines, between the machines and the bowler. The purpose of these cover panels was originally both for esthetics and to avoid the distractions of the movement of the pin setter. These cover panels quickly became the subject of invention as lights behind the cover panels were used to indicate the number of pins that had fallen and to provide a visual representation of the pins that were left standing. These cover panels and related devices evolve to include a number of features such as indicators for strikes, spares, whether the first ball of the frame had been thrown and eventually where the ball needed to placed in order to achieve a spare. Other signaling lights on the panel indicated the occurrence of a foul when the bowler slipped past the bowling alley foul line.

Other inventors turned their attention to the issue of esthetics. This resulted in the development of different colored panels and panels that provided attractive light displays on the occurrence of particular events such as a strike or a spare.

After the bowling industry went through this period of tremendous growth, there began to be a retrenching. No longer was walk in business which is commonly referred to as open bowling, sufficient to add significant financial support to the various bowling alleys. Since the alleys could not count on walk in business, they directed their effort to the further development of bowling leagues. These leagues, although usually given a preferential rate were consistent customers and allowed for inter and intraleague competitions, company leagues and the like. Today, a successful bowling alley is one that has the facilities to attract the most league players. Accordingly, bowling alleys have gone out of their way to provide an environment that the leagues feel comfortable with. This generally includes, among other things league recognition which is accomplished by signs as you walk into the establishment as well as diagrams of league standings and the like.

While variations to the cover panels have been made to make them more esthetically pleasing, actually personalizing such cover panels for the various bowling leagues that a bowling alley may serve would require frequent panel changes which would presently be too time consuming. Most cover panels are approximately 5½ feet long and 3 feet high. Although they may be made of a plastic material and, therefore may not be very heavy, they tend to bend and with present installations at least two people are required to remove and replace the panels. Presently the cover panels are bolted to a support in front of the pin setting machine. Due to the fact that multiple alleys ar adjacent to each other the cover panels are also adjacent to each other, end to end, with little room between adjacent panels. Therefore, removing and replacing a panel is quite difficult as one attempts to maneuver these large panels around the adjacent panels. Where a particular league takes up 20 lanes it will be appreciated that even a twenty minute period to change the cover panel on each lane would result in over 6½ hours of work in order to install personalized cover panels.

Efforts by some to change the cover panel system have resulted in totally free standing systems which are moved closer to the bowler in order to provide greater access to the cover panel detaching mechanisms. For example, in one invention the cover panel pivots centrally, which would be impossible with the present placement due to interference from the pin setting machine. Of course the movement of the cover panel toward the bowler also alters the bowlers perspective and effects the lighting on the alley. Furthermore, even with changes such as these one still must unbolt the panel for removal.

Presently the cover panels attach to a support which lifts up from the bottom and locks in place in order to provide access to the pin setter. One may also then position ones selves under the now raised panel to accomplish the necessary bolting and unbolting in order to change the cover panel.

Accordingly, there does not exist in the industry an easy and effective way of building new, or retrofitting existing, bowling machine assemblies to provide a secure yet easily removable cover panel which would allow bowling alley owners greater variety in personalizing these cover panels or simply altering the esthetics of the bowling alley.

SUMMARY OF THE INVENTION

The present invention is a frame assembly which may be used to replace the existing cover panel supports on most bowling machines. This assembly frames the top and bottom of the cover panel and allows for the necessary indicators to be located directly into the frame so that at a minimal cost personalized cover panels may be used without altering the necessary dissemination of information to the bowler. The sides of the frame are open to facilitate the sliding of panels into and out of the frame. This is accomplished with a plurality of separate slots of which, the forward most slot serves as the holder for the front cover panel and rear slots for alternate cover panels to be kept on reserve at the site of transfer. By using separate slots, each of these cover panels is actually held within its own frame thereby avoiding any friction between panels during the transfer of panels.

Due to the fact that the cover panels are adjacent to each other, it would not be possible to slide the panels out of the sides of the frame. This is true even where the frame is raised as it could be with some present machinery. Therefore, an essential element of the subject invention is an offset block which, when the frame is moved to its open position, positions the cover panels so that their removal will not only clear adjacent frames and panels but actually allow the adjacent frame to be used as a support.

Thus, the frame of the subject invention not only allows for the easy exchange of cover panels between the front cover panel and separately stored rear cover panels but is designed to work with existing pin setter machinery to allow for easy retrofitting and renovation.

The above features and the various advantages incorporated therein will become more evident through a study of the subject disclosure and through the use of the invention.

DETAILED DESCRIPTION OF THE PREFERRED EMBODIMENT

Figure 1:
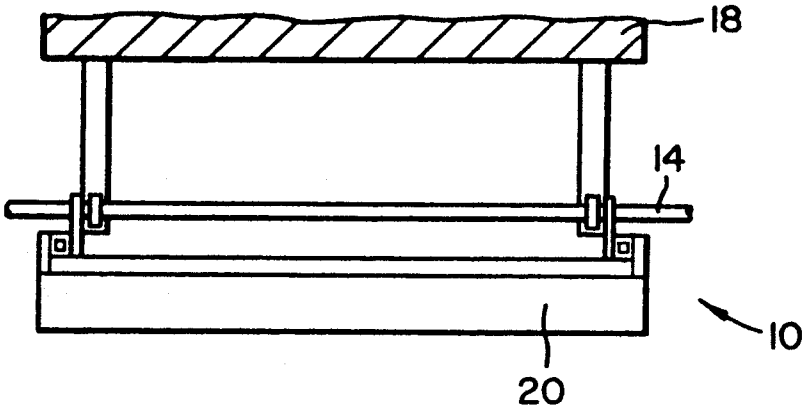
FIG. 1 is a top view of the invention.

As shown in FIG. 1 the frame, generally designated as 10, is secured to a spacer 12 that pivotably attaches to round bar 14 which is part of the original pin setter machine. The bar is secured to the rest of the pin setter machine by braces 16 which extend outwardly from either side of the pin setting machine 18.

Figure 2:
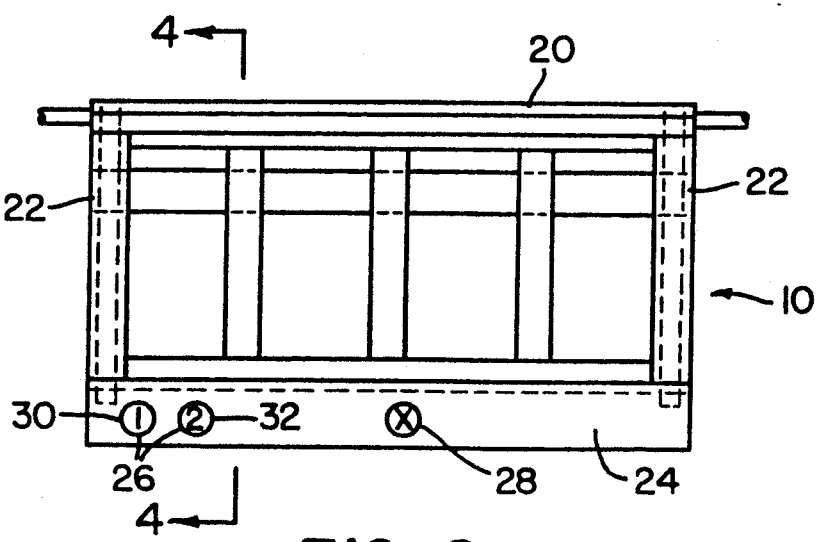
FIG. 2 is a front elevational view showing the invention mounted on an existing pin setter machine.

As shown in FIG. 2, which is a front elevational view of the invention, the frame has a top support 20, side supports 22 and a bottom support 24. Extending through the bottom support 24 are cut outs 26 for bowling indicia such as the center strike signal 28 and the first or second ball indicators 30 and 32 respectively. Of course, other indicia could be placed in either the top support 20 or bottom support 24 if desired.

Figure 3:
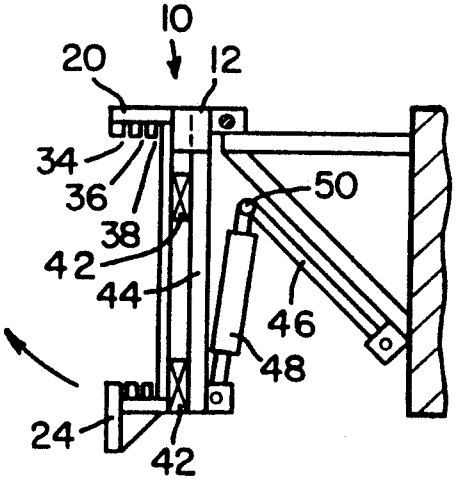
FIG. 3 is a side elevational view of the invention in place on a pin setter machine.
Figure 4:
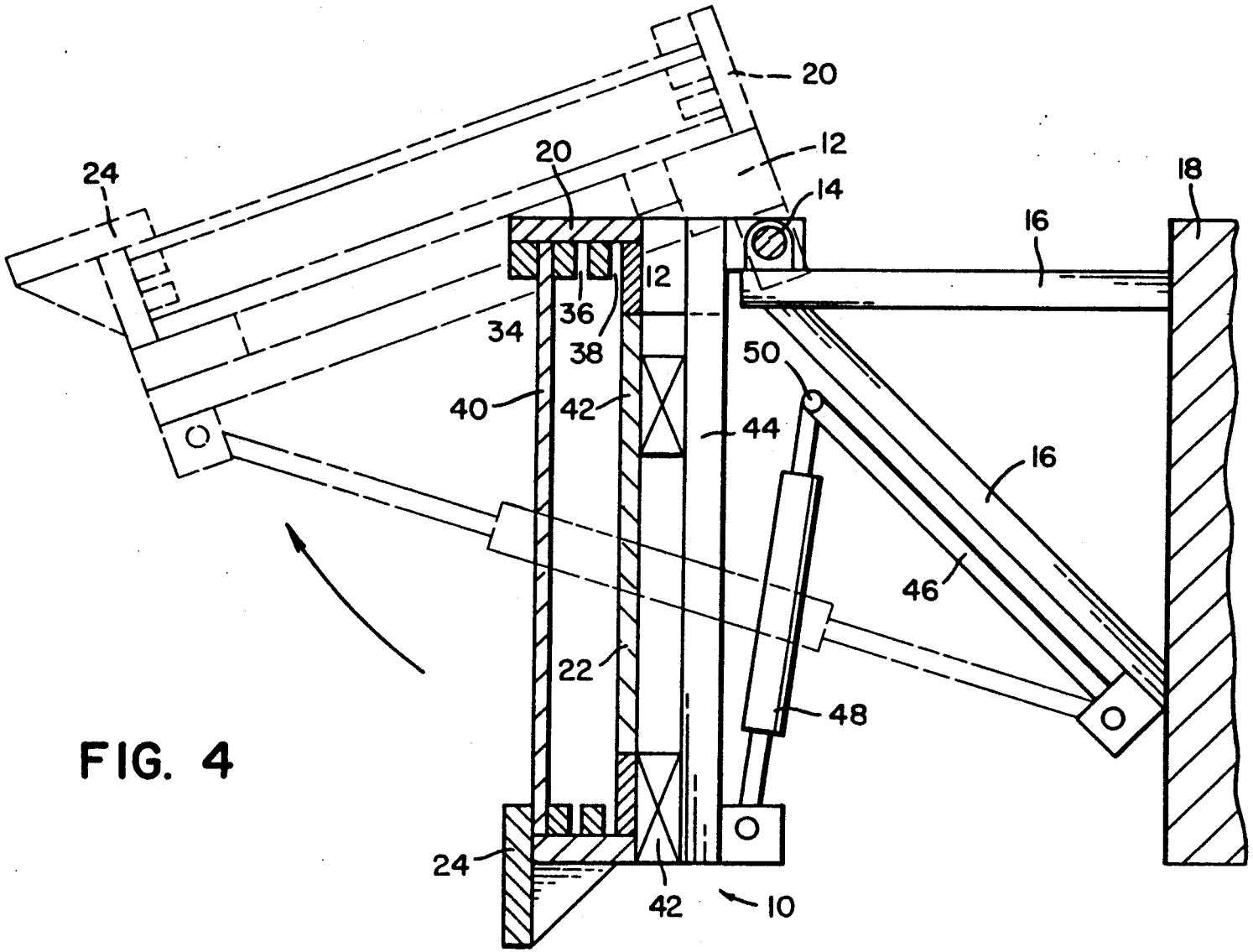
FIG. 4 is a side elevational view taken along lines 4—4 in FIG. 2 and showing the open position of an adjacent frame in phantom and its relationship to frame and panel structures in the closed position.

As shown in FIG. 3 the sides of the frame are open and slots 34, 36 and 38 in the top supports 20 and bottom support 24 allow for the insertion of a cover panel 40 as shown in FIG. 4. The spacer for off setting the frame attaches around the bar 14 for pivotal movement. Secondary spacers 42 are inserted between the side supports 22 and the preexisting pin setter panel support 44. The pin setter panel supports 44 align with the side supports 22 of the frame, are secured to it, and are held in a spaced apart relationship from each other by the secondary spacers 42.

Secured to each pin setter panel support 44 is a locking hinge 46 which has a slidable sleeve 48. Moving the locking hinge to its extended position, as shown in phantom in FIG. 4, allows for the sleeve 48 to be slid over the hinge 50 to lock the hinge in a straight position and the frame in an angled position.

As shown in FIG. 4 the frame is secured to the original pin setter machine framework and may be moved to a closed position. In the closed position the cover panel is substantially vertical to the ground and lies in front of the pin setter. As shown in phantom the frame can also be moved to an open position by pivoting the cover panel and frame mechanism toward a horizontal position and locking it by means of the locking hinge 46, with frame being locked in an angled position as shown. When in the angled position the cover panel 40, or other cover panels (not shown) which could be placed in slots 36 and 38, can be slid from the side of the frame 10 bypassing adjacent closed frames. More specifically when in an open position all of the cover panels lie in a plane which is completely separate and distinct and does not bisect or intersect with any of the adjacent cover panels when the said adjacent cover panels are in the closed position. Instead these open cover panels lie above and in front of their adjacent frame and panel structures.

When panels are slid from an angled frame they can actually rest on the top support 20 of an adjacent frame.

In operation, a user simply takes hold of the bottom support 24 and raises it forward and upwardly toward the horizontal. The frame 10 will stop when the locking hinge 46 is fully extended. Sleeve 48 is then slid over the hinge 50 thereby locking the frame in an angled position as shown in FIG. 4. One then takes hold of the side of the cover panel 40 and slides it out of its slot 34 from one of the sides of the frame. If one of the rear slots, 36 or 38 are open the front panel can be removed from its slot and dropped down to one of said rear slots where it may simply be pushed into place. The new panel, if stored in a rear slot may be slid out of place and directed into the front slot 34. In doing this the user is aided by the fact that the panels, during removal or insertion, may rest upon the top support 20 of an adjacent frame. The sleeve 48 is slid from its position around hinge 50 and the frame is returned to the closed position. The user then moves to the next adjacent frame and repeats the procedure. An experimental installation has shown that the entire process of changing a panel for a lane can be completed by one person in less than 1.5 minutes. Twenty lanes for a league can be personalized in less than one half hour. Similarly, special panels which indicate open bowling lanes can be used to ease the placement of non-league bowlers.

While the above describes a preferred embodiment of the invention it is expected that the scope of the invention should only be limited by the appended claims.

I claim:

1. A cover panel mechanism for adjacent bowling alley pin setter machines comprising:

a plurality of frame members each adapted to receive a cover panel, each of said frame members pivotably secured to a pin setter machine framework for movement between a closed position where the cover panel is in a vertical position in front of the pin setter, thereby blocking the view of the pin setter from a bowling alley user, a plurality of said cover panels in the closed position forming a series of adjacent cover panels lying in substantially the same plane, and an open position where the cover panel is pivoted toward the horizontal to an angled position where said open cover panel lies in a plane which is completely separate and distinct and does not intersect or bisect adjacent cover panels when said adjacent panels are in the closed position; and means for locking the frame in said angled position.

2. The invention of claim 1 wherein said frame further comprises a front holder for a front panel and rear holders for substitute panels which are located between said front panel and the pin setter machine.

3. The invention of claim 2 where there are at least two holders and said holders are slotted and each of said holders is a slot within the frame adapted to receive one panel thereby holding said panels in a separate spaced apart relationship one from another.

4. The invention of claim 1 wherein said frame has a top support, a bottom support and side supports securing said top and bottom supports; and a spacer off sets the frame from this pin setter framework and secures it thereto.

5. The invention of claim 3 wherein said slots all open on the sides of the frame so that in the open position the front panel may be slid from the front most slot and dropped from the front holder into an empty rear holder.

6. The invention of claim 1 wherein said frame further comprises a bottom support having cut outs therein to receive bowling status indicia.

* * * * *